US010391540B2

(12) United States Patent
Gerstenslager

(10) Patent No.: US 10,391,540 B2
(45) Date of Patent: Aug. 27, 2019

(54) BOWL FORMING DEVICE AND METHOD

(71) Applicant: Kevin Gerstenslager, Doylestown, OH (US)

(72) Inventor: Kevin Gerstenslager, Doylestown, OH (US)

( * ) Notice: Subject to any disclaimer, the term of this patent is extended or adjusted under 35 U.S.C. 154(b) by 378 days.

(21) Appl. No.: 15/367,595

(22) Filed: Dec. 2, 2016

(65) Prior Publication Data

US 2018/0154425 A1 Jun. 7, 2018

(51) Int. Cl.
*B21D 51/16* (2006.01)
*A24F 1/32* (2006.01)
*B21D 49/00* (2006.01)

(52) U.S. Cl.
CPC ..... *B21D 51/16* (2013.01); *A24F 1/32* (2013.01); *B21D 49/005* (2013.01)

(58) Field of Classification Search
CPC ..... B21D 51/16; B21D 49/005; B29C 63/00; A24F 1/32; A24F 5/00
USPC ..... 131/226, 328
See application file for complete search history.

(56) References Cited

U.S. PATENT DOCUMENTS 3,902,505 A 9/1975 Carleton
5,850,838 A 12/1998 Sigrist
6,698,435 B2 3/2004 Miller
8,973,586 B2 3/2015 Walsh
2006/0016454 A1 1/2006 Wilson
2009/0235939 A1 9/2009 Gonsalves
2011/0308538 A1* 12/2011 Jarvis ..... A24F 1/32 131/226
2015/0144146 A1* 5/2015 Selby ..... A24F 1/28 131/328
2016/0249678 A1 9/2016 Katz

* cited by examiner

*Primary Examiner* — Shelley M Self
*Assistant Examiner* — Jared O Brown
(74) *Attorney, Agent, or Firm* — Patentfile, LLC; Bradley C. Fach; Steven R. Kick

(57) ABSTRACT

A bowl forming device may include a mandrel sleeve, a stem mandrel, and a bowl mandrel. The mandrel sleeve may comprise a stem cavity, a bowl mating surface, and a sleeve surface. The stem mandrel may comprise a stem surface and a neck. The bowl mandrel may comprise a neck mating surface and a bowl surface. The device may be transitioned into and out of a nested position, in which the bowl mandrel may be mated with both the mandrel sleeve and the stem mandrel so that the stem mandrel may be received within the stem cavity and the sleeve mating surface contacts the bowl mating surface, to facilitate travel and storage of the device. A method of forming a smoking bowl using a bowl forming device is provided which includes the steps of forming a sheet of malleable material against the mandrel sleeve, stem mandrel, and bowl mandrel.

16 Claims, 6 Drawing Sheets

BOWL FORMING DEVICE AND METHOD

FIELD OF THE INVENTION

This patent specification relates to the field of devices and methods for making a smoker's pipe. More specifically, this patent specification relates to a device, and methods of use, that has a small footprint and that is able to form a smoking pipe out of any malleable flame resistant material.

BACKGROUND

The smoking of plant-based materials such as tobacco and herbaceous substances is a common practice throughout the world for both medicinal and recreational purposes. A smoker's pipe, often called a "bowl", is a popular apparatus which facilitates smoking of the plant based materials without requiring the use of other combustibles, such as rolling papers and wrappers, which may contribute unwanted contaminants and flavors to the smoke. These pipes have a bowl shaped chamber for receiving and burning of the plant based materials and a conduit for conveying the smoke from the bowl shaped chamber to the mouth of the user.

Traditionally, pipes or bowls are made of durable materials and can include metal, wood, ceramic, stone, glass, and other durable flame resistant materials. While these materials are durable, they are often fragile and bulky. This can make it difficult to travel with a pipe as care must be taken to protect the pipe and also to prevent the residue from burnt material in the bowl from inadvertently exiting the bowl. Disposable pipes attempt to address these short comings. While commercial disposable pipes exist, they are not inexpensive and can be difficult to locate for purchase. Homemade disposable pipes may be made from many sources and materials, such as fruit and various metal objects and materials, often require a great deal of skill to fabricate which can leave the average smoker with an unsatisfying smoking experience.

Therefore a need exists for novel devices and methods for making a smoker's pipe or bowl. There is also a need for novel bowl forming devices and methods which do not require a smoker from having to take care to protect their bowl and also to prevent the residue from burnt material in the bowl from inadvertently exiting the bowl during travel. Finally, a need exists for novel bowl forming devices and methods which may be used to quickly and easily fabricate a bowl from any malleable flame resistant material.

BRIEF SUMMARY OF THE INVENTION

A bowl forming device is provided which may be used to form a bowl or smoker's pipe from any malleable and flame resistant material which may be worked or pressed against portions of the device and once pressed may retain their pressed shape. In some embodiments, the device may include a mandrel sleeve, a stem mandrel, and a bowl mandrel. The mandrel sleeve may have a stem cavity, a bowl mating surface, and a sleeve surface. The stem mandrel may have a stem surface and a neck. The bowl mandrel may have a neck mating surface and a bowl surface.

In further embodiments, the device may be transitioned into and out of a nested position, in which the bowl mandrel may be mated with both the mandrel sleeve and the stem mandrel so that the stem mandrel may be received within the stem cavity and the sleeve mating surface may contact the bowl mating surface, to facilitate travel and storage of the device.

According to another aspect consistent with the principles of the invention, a method of forming a bowl with a sheet of malleable material using a bowl forming device is provided. The method may include the steps of: wrapping the malleable material around the sleeve surface of the mandrel sleeve and around the bowl surface of the bowl mandrel to form the malleable material into a cylinder, replacing the mandrel sleeve with the stem mandrel within the malleable material cylinder, forming the malleable material cylinder against the stem mandrel, and removing the stem mandrel and the bowl mandrel from the malleable material.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
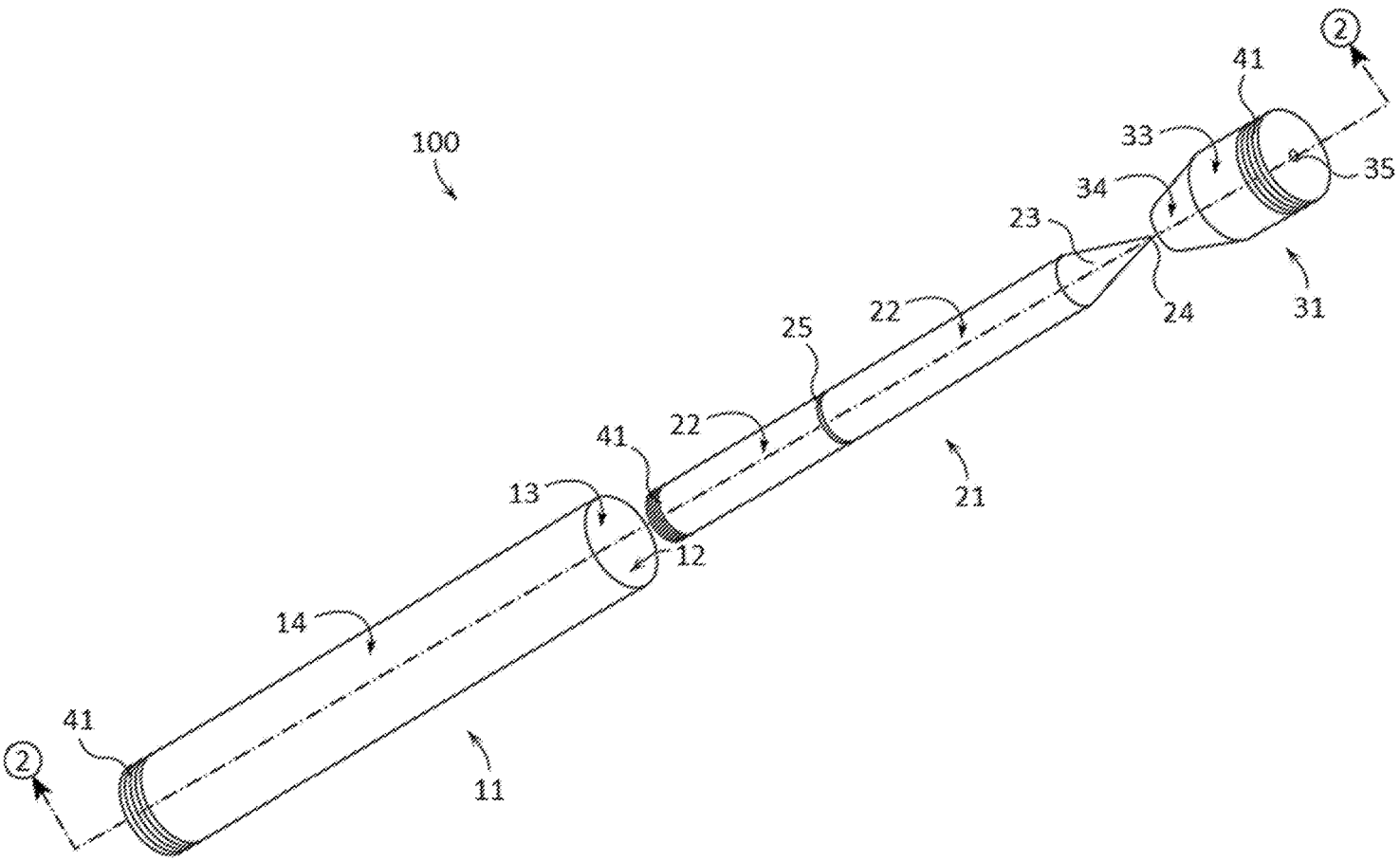
FIG. 1 depicts a perspective view of the components of an example of a bowl forming device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

New bowl forming devices and methods are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 2:
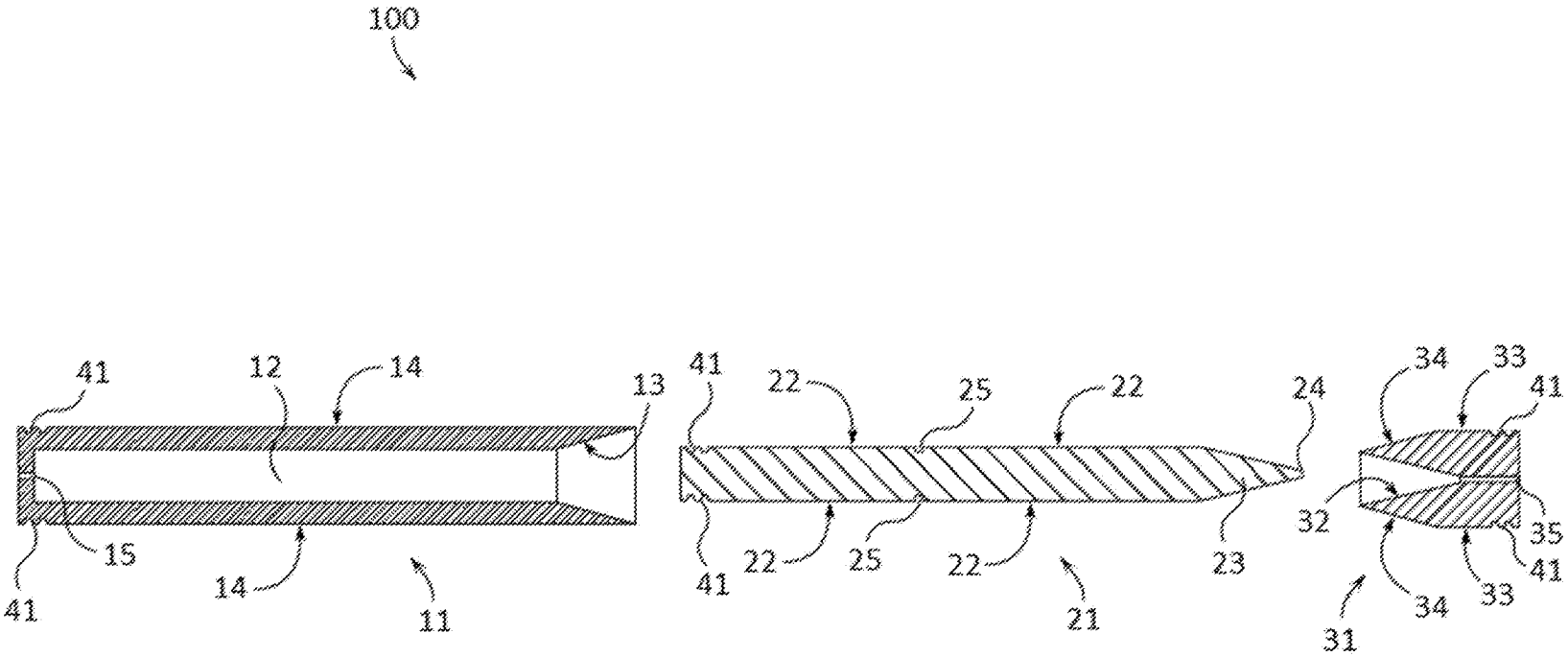
FIG. 2 illustrates a sectional, through line 2-2 shown in FIG. 1, elevation view of an example of a bowl forming device according to various embodiments described herein.

The present invention will now be described by example and through referencing the appended figures representing preferred and alternative embodiments. FIGS. 1 and 2 illustrate an example of a bowl forming device ("the device") 100 according to various embodiments. In this example, the device 100 includes a mandrel sleeve 11, a stem mandrel 21, and a bowl mandrel 31. The mandrel sleeve 11 may comprise a stem cavity 12, a bowl mating surface 13, and a sleeve surface 14. The stem mandrel 21 may comprise a stem surface 22 and a neck 23. The bowl mandrel 31 may comprise a neck mating surface 32 and a bowl surface 33.

The device 100 may be transitioned into and out of a nested position 71 (FIGS. 3 and 4), in which the bowl mandrel 31 is mated with both the mandrel sleeve 11 and the stem mandrel 21 so that the stem mandrel 21 is received within the stem cavity 12 and the sleeve mating surface 14 contacts the bowl mating surface 13, to facilitate travel and storage of the device 100.

The device 100 may be used to form a bowl or smoker's pipe from any malleable material 400 (FIGS. 6-10) that is preferably flame resistant which may be worked or pressed against portions of the device 100 and once pressed may retain their pressed shape. In preferred embodiments, the device 100 may be used to form a bowl 301 (FIG. 10) or smoker's pipe from malleable material 400 that is or comprises aluminum foil. In further embodiments, the device 100 may be used to form a bowl 301 or smoker's pipe from malleable material 400 that is or comprises tin foil, copper foil, or any other metal and metal alloy type of foil, sheet, or the like.

Figure 3:
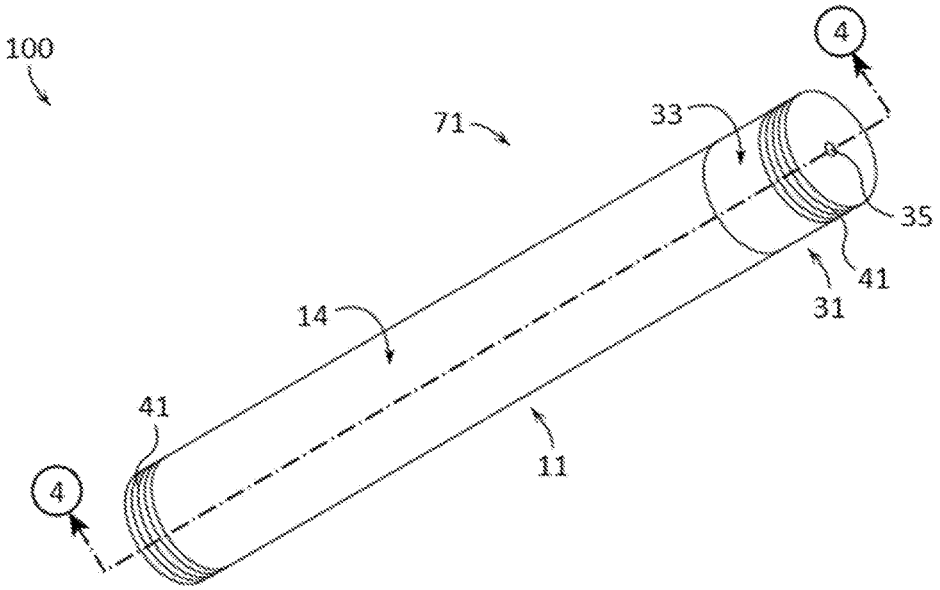
FIG. 3 shows a perspective view of the components of an example of a bowl forming device mated together in a nested position according to various embodiments described herein.

As shown in FIGS. 1 and 3, the mandrel sleeve 11 may comprise a sleeve surface 14 which may have an elongated shape, such as a cylindrical shape, that is generally greater in length than width. In other embodiments, the sleeve surface 14 may comprise an elongated rectangular prism shape, elongated triangular prism shape, a conical shape including frustoconical, or any other shape.

Figure 4:
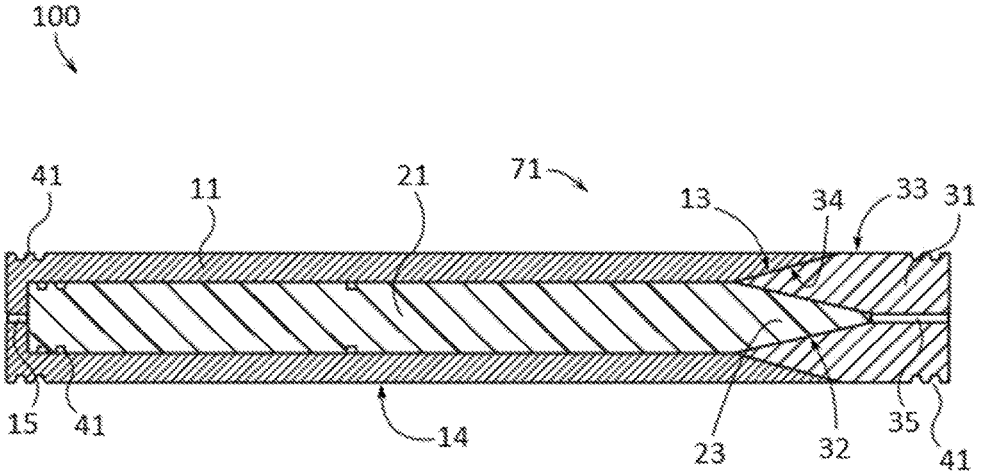
FIG. 4 depicts a sectional, through line 4-4 shown in FIG. 3, elevation view of an example of a bowl forming device in a nested position according to various embodiments described herein.

The mandrel sleeve 11 may comprise a stem cavity 12 which may be shaped to receive portions of a stem mandrel 21 and/or portions of a bowl mandrel 31 as perhaps best shown in FIG. 4. In some embodiments, the mandrel sleeve 11 may comprise a bowl mating surface 13 which may contact portions of the bowl mandrel 31, such as a sleeve mating surface 34. In preferred embodiments, the bowl mating surface 13 may be conical in shape. In further embodiments, the bowl mating surface 13 may comprise a conical shape that is generally frustoconical.

The stem mandrel 21 may comprise a stem surface 22 which may have an elongated shape, such as a cylindrical shape, that is generally greater in length than width. In other embodiments, the stem surface 22 may comprise an elongated rectangular prism shape, elongated triangular prism shape, a conical shape including frustoconical, or any other shape. The stem surface 22 may be smaller than the stem cavity 12 so that portions of the stem surface 22, and therefore portions of the stem mandrel 21, may be positioned or received within the stem cavity 12. Optionally, all or portions of the stem cavity 12 and stem surface 22 may be similar in shape. For example, the stem cavity 12 and stem surface 22 may both the cylindrical in shape. Alternatively, all or portions of the stem cavity 12 and stem surface 22 may be different in shape. For example, the stem cavity 12 may be cylindrical in shape and stem surface 22 may be elongated triangular prism in shape.

In some embodiments, the stem mandrel 21 may comprise a neck 23 which may contact the neck mating surface 32 of the bowl mandrel 31 when the device 100 is in the nested position 71 (FIGS. 3 and 4). In preferred embodiments, the neck 23 may be tapered to a point 24. The point 24 may be a blunt or rounded shape point, a sharp point, or any other shape which the neck 23 may transition the stem surface 22 into. In further preferred embodiments, the neck 23 may be conical in shape.

Optionally, the stem mandrel 21 may comprise one or more indicators 25 which may be positioned anywhere along the stem surface 22. In some embodiments, an indicator 25 may be formed into the stem surface 22 such as a notch, divot, channel, groove, protrusion, bump, or any other type or form of texturing which may be raised above or below the stem surface 22. In other embodiments, an indicator 25 may comprise a marking, decal, word, letter, symbol or other type of indicia which may be applied to the step surface 22. Generally, an indicator 25 may provide a landmark on the stem mandrel 21 which may direct the user to position portions of the stem mandrel 21 in relation to a malleable material 400, such as aluminum foil, which may be used formed against the stem surface 22 and/or neck 23.

The bowl mandrel 31 may comprise a neck mating surface 32, a bowl surface 33, and/or a sleeve mating surface 34. The bowl surface 33 may be coupled to a sleeve mating surface 34. In some embodiments, the bowl surface 33 may be cylindrical in shape. In alternative embodiments, the bowl surface 33 may be conical in shape such as frusto-conical. In further embodiments, the sleeve mating surface 34 may be conical in shape. In still further embodiments, the sleeve mating surface 34 may comprise a conical shape that is generally frustoconical. In some embodiments, the neck mating surface 32 may be conical in shape.

It should be understood to one of ordinary skill in the art that the stem cavity 12, bowl mating surface 13, sleeve surface 14, stem surface 22, neck 23, point 24, indicators 25, eck mating surface 32, bowl surface 33, and sleeve mating surface 34 may each be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

In some embodiments, the mandrel sleeve 11 may comprise a sleeve vent 15. A sleeve vent 15 may be a channel, aperture, or the like, which may extend through portions of the mandrel sleeve 11 and into the stem cavity 12. One or more sleeve vents 15 may enable air to pass through the mandrel sleeve 11 and into the stem cavity 12 to prevent a vacuum from being created when the mandrel sleeve 11 is being used to form portions of a bowl 301 such as the conduit 302.

Similarly and in some embodiments, the bowl mandrel 31 may comprise a bowl vent 35. A bowl vent 35 may be a channel, aperture, or the like, which may extend through portions of the bowl mandrel 31 and into the neck mating surface 32. One or more bowl vents 35 may enable air to pass through the bowl mandrel 31 and into the neck mating surface 32 to prevent a vacuum from being created when the bowl mandrel 31 is being used to form portions of a bowl 301 such as the bowl chamber 303.

Optionally, the mandrel sleeve 11, stem mandrel 21, and/or bowl mandrel 31 may comprise texturing 41 which may facilitate a user gripping and manipulating the mandrel sleeve 11, stem mandrel 21, and/or bowl mandrel 31. Texturing 41 may include or comprise a notch, divot, channel, groove, protrusion, bump, or any other type or form of texturing which may be facilitate a user gripping and manipulating the mandrel sleeve 11, stem mandrel 21, and/or bowl mandrel 31, such as when transitioning the device 100 into and out of the nested position 71 and when using the device 100 to form a bowl 301 according to the method 200 described in FIG. 5.

Turning now also to FIGS. 3 and 4, in some embodiments, the device 100 may be transitioned into and out of a nested position 71. The nested position 71 may enable the mandrel sleeve 11, stem mandrel 21, and the bowl mandrel 31 to be nested or mated together to facilitate travel and storage of the device 100. For example, the mandrel sleeve 11 and the bowl mandrel 31 may be nested or mated together with portions of the stem mandrel 21 maintained between the mandrel sleeve 11 and the bowl mandrel 31 in the stem cavity 12.

In preferred embodiments, portions of the stem mandrel 21 and bowl mandrel 31 may be nested or mated together when the device 100 is in the nested position 71. In further embodiments, the neck 23 may be conical in shape and the neck mating surface 32 may comprise a conical shape that is complementary to the conical shape of the neck 23 so that all or portions of the neck 23 may contact all or portions of the neck mating surface 32 when the bowl mandrel 31 is mated to both the mandrel sleeve 11 and the stem mandrel 21 when the device is in the nested position 71.

Optionally, the neck 23, and therefore the stem mandrel 21 may be removably coupled to the bowl mandrel 31. In some embodiments, the neck 23 may be complementary in shape to the neck mating surface 32 so that the stem mandrel 21 may be removably coupled to the bowl mandrel 31 by press fitting the neck 23 into contact with the neck mating surface 32. For example, the neck 23 may comprise a conical shape and the neck mating surface 32 may comprise slightly larger conical shape so that when the neck 23 is pressed into contact with the neck mating surface 32, the neck 23 and neck mating surface 32 may be removably coupled together with friction or a press fit frictional coupling. In other embodiments, the neck 23 and neck mating surface 32 may be removably coupled together with one or more other types of removable frictional coupling methods, with magnets, with threading, with a turn-to-lock connection method, or any other removably coupling method.

In preferred embodiments, portions of the mandrel sleeve 11 and bowl mandrel 31 may be nested or mated together when the device 100 is in the nested position 71. In further embodiments, the bowl mating surface 13 may be conical in shape and the sleeve mating surface 34 may comprise a conical shape that is complementary to the conical shape of the bowl mating surface 13 so that all or portions of the bowl mating surface 13 may contact all or portions of the sleeve mating surface 34 when the mandrel sleeve 11 is mated to both the bowl mandrel 31 and the stem mandrel 21 when the device is in the nested position 71.

Optionally, the bowl mating surface 13, and therefore the mandrel sleeve 11 may be removably coupled to the sleeve mating surface 34. In some embodiments, the bowl mating surface 13 may be complementary in shape to the sleeve mating surface 34 so that the mandrel sleeve 11 may be removably coupled to the bowl mandrel 31 by press fitting the sleeve mating surface 34 into contact with the bowl mating surface 13. For example, the sleeve mating surface 34 may comprise a conical shape and the bowl mating surface 13 may comprise slightly larger conical shape so that when the sleeve mating surface 34 is pressed into contact with the bowl mating surface 13, the sleeve mating surface 34 and bowl mating surface 13 may be removably coupled together with friction or a press fit frictional coupling. In other embodiments, the sleeve mating surface 34 and bowl mating surface 13 may be removably coupled together with one or more other types of removable frictional coupling methods, with magnets, with threading, with a turn-to-lock connection method, or any other removably coupling method.

Figure 5:
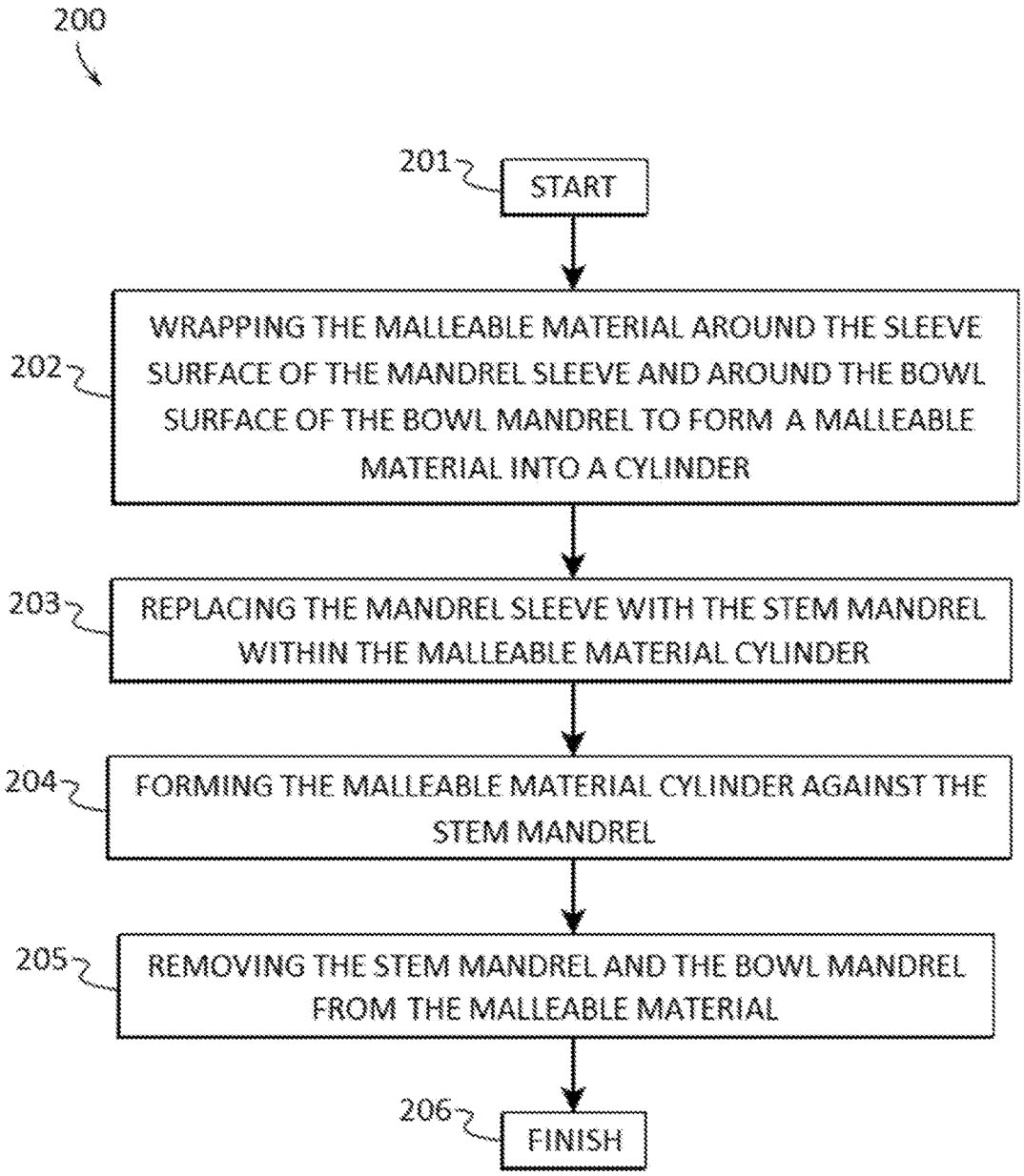
FIG. 5 illustrates a block diagram of an example of a method of forming a bowl according to various embodiments described herein.
Figure 6:
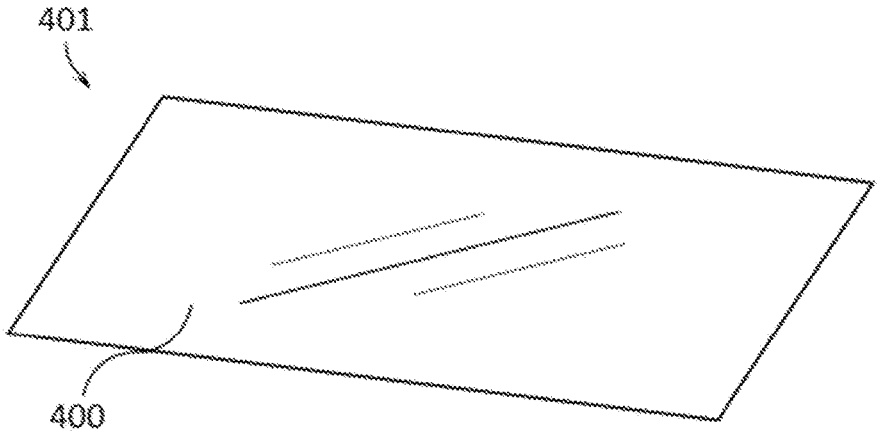
FIG. 6 shows a perspective view of an example of a sheet of malleable material according to various embodiments described herein.

FIG. 5 illustrates a block diagram of an example of a method of forming a bowl ("the method") 200 according to various embodiments described herein. The method 200 may be used to form a bowl 301 or smoking pipe from a malleable material 400 using a bowl forming device 100 (FIGS. 1-4). In preferred embodiments, the method 200 may be used to form a malleable material 400 that is a sheet 401 (FIG. 6) of malleable material 400, such as aluminum foil, tin foil, and the like, into a bowl 301 (FIG. 10) or smoking pipe.

Figure 7:
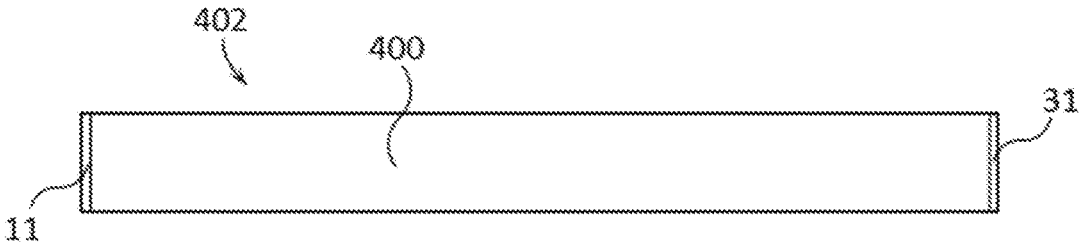
FIG. 7 depicts a side elevation view of an example of a malleable material in cylinder form wrapped and formed around a mandrel sleeve and a bowl mandrel according to various embodiments described herein.

The method 200 may begin 201 and the malleable material 400 may be wrapped around the sleeve surface 14 of the mandrel sleeve 21 and around the bowl surface 33 of the bowl mandrel 31 to form the malleable material into a cylinder 402 in step 202 as shown in FIG. 7. In some embodiments, the method 200 may further include the step of forming the malleable material cylinder 402 against the sleeve mating surface 34 of the bowl mandrel 31. In further embodiments, portions of the mandrel sleeve 11 and bowl mandrel 31 may be nested or mated together when the malleable material 400 may be wrapped around the sleeve surface 14 of the mandrel sleeve 21 and around the bowl surface 33 of the bowl mandrel 31. In further embodiments, the bowl mating surface 13 and the sleeve mating surface 34 may be removably coupled together when the malleable material 400 may be wrapped around the sleeve surface 14 of the mandrel sleeve 21 and around the bowl surface 33 of the bowl mandrel 31.

Figure 8:
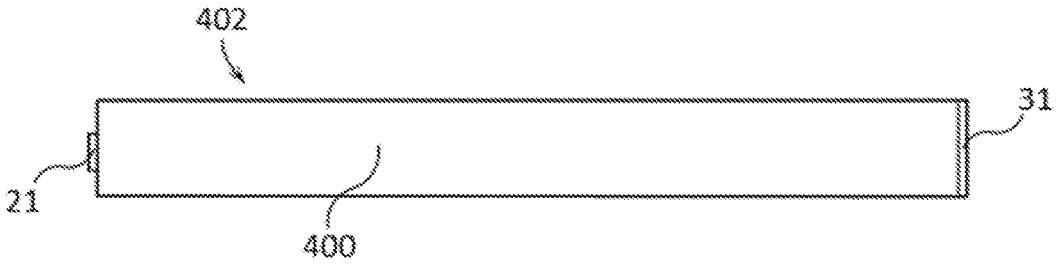
FIG. 8 illustrates a side elevation view of an example of a malleable material in cylinder form wrapped around a stem mandrel and a bowl mandrel according to various embodiments described herein.

Next in step 203, the mandrel sleeve 11 may be replaced with the stem mandrel 21 within the malleable material cylinder 402 formed in step 202 as shown in FIG. 8. In some embodiments, the mandrel sleeve 11 may be removed from within the malleable material cylinder 402 and the stem mandrel 21 may be placed within the malleable material cylinder 402 so that the stem mandrel 21 replaces the mandrel sleeve 11 within the malleable material cylinder 402.

Figure 9:
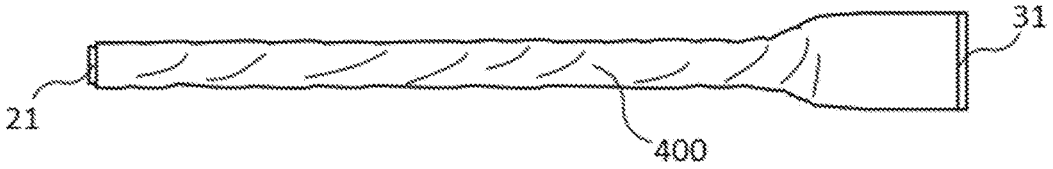
FIG. 9 shows a side elevation view of an example of a malleable material in cylinder form wrapped and formed around a stem mandrel and a bowl mandrel according to various embodiments described herein.
Figure 10:
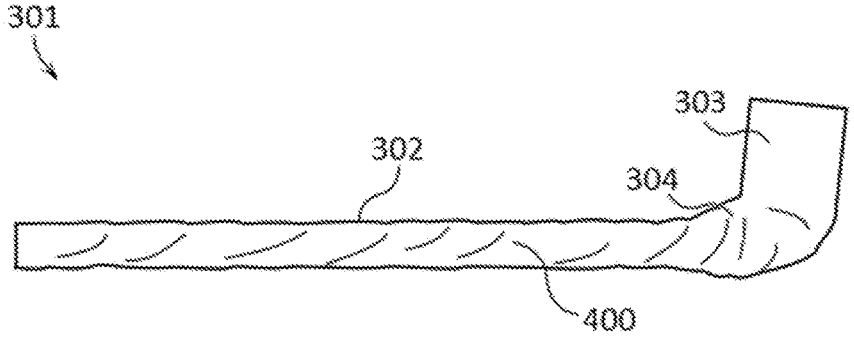
FIG. 10 depicts a side elevation view of an example of a bowl or smoker's pipe made of malleable material according to various embodiments described herein.

In step 204, the malleable material cylinder 402 may be formed against the stem mandrel 21 as shown in FIG. 9. In some embodiments, the malleable material cylinder may be formed against the stem surface 22 of the stem mandrel 21, thereby reducing the width of the malleable material cylinder 402. In further embodiments, portions of the malleable material cylinder 402 may be formed against the neck 23 of the stem mandrel 21, thereby further reducing the width of portions of the malleable material cylinder 402. Optionally, portions of the stem mandrel 21 may be withdrawn from the malleable material cylinder 402, such as up to an indicator 25 (FIGS. 1 and 2), so that a user may further form or compress the portions of the malleable material cylinder not supported by the stem mandrel 21 and further form or compress portions of the malleable material cylinder 402 against the neck 23.

Next in step 205, the stem mandrel 21 and the bowl mandrel 31 may be removed from the malleable material 400 resulting in the formation of a bowl 301 or smoker's pipe. In this manner, portions of the malleable material 400 which were formed against the bowl mandrel 31 may retain the shape of portions of the bowl mandrel 31, such as the bowl surface 33 and/or sleeve mating surface 34, thereby allowing these portions to be shaped and function as the bowl chamber 303 (FIG. 10) of a bowl 301 or smoker's pipe. Similarly in this manner, portions of the malleable material 400 which were formed against the stem mandrel 21 may retain the shape of portions of the stem mandrel 21, such as the neck 23 and/or stem surface 22, thereby allowing these portions to be shaped and function as the conduit 302 (FIG. 10) between the bowl chamber 303 and the mouth of a user of the bowl 301 or smoker's pipe. Optionally, the portion of the malleable material 400 comprising the bowl 301 or smoker's pipe which was formed into the bowl chamber 303 may be bent into a bend 304 relative to the portion of the malleable material 400 comprising the bowl or smoker's pipe which was formed into the conduit 302, thereby giving the bowl or smoker's pipe an "L" shape or other common bend 304 typical of bowls or smoker's pipes. After step 205, the method 200 may finish 206

While some materials have been provided, in other embodiments, the elements that comprise the device 100 such as the mandrel sleeve 11, stem mandrel 21, bowl mandrel 31, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A bowl forming device, the device comprising:

a mandrel sleeve having a stem cavity, a bowl mating surface, and a sleeve surface;

a stem mandrel having a stem surface and a neck, wherein the neck is tapered to a point;

a bowl mandrel having a sleeve mating surface and having a conically shaped hollow area formed by a conically shaped neck mating surface for accepting the neck of the stem mandrel; and wherein the bowl mandrel is configured to mate with both the mandrel sleeve and the stem mandrel so that when the stem mandrel is received within a stem cavity of the mandrel sleeve, the sleeve mating surface on the bowl mandrel contacts the bowl mating surface on the mandrel sleeve.

2. The device of claim 1, wherein the neck contacts the neck mating surface when the bowl mandrel is mated to both the mandrel sleeve and the stem mandrel.

3. The device of claim 1, wherein the neck is conical in shape.

4. The device of claim 1, wherein the stem surface is cylindrical in shape.

5. The device of claim 1, wherein the sleeve surface is cylindrical in shape.

6. The device of claim 1, wherein the bowl surface is cylindrical in shape.

7. The device of claim 1, wherein the stem mandrel comprises an indicator.

8. The device of claim 7 wherein the indicator is formed into the stem surface.

9. The device of claim 1, wherein the mandrel sleeve is removably coupled to the bowl mandrel.

10. The device of claim 9, wherein the bowl mating surface is complementary in shape to the sleeve mating surface so that the mandrel sleeve is removably coupled to the bowl mandrel by press fitting the bowl mating surface into contact with the sleeve mating surface.

11. The device of claim 1, wherein the neck is removably coupled to the bowl mandrel.

12. The device of claim 11, wherein the neck is complementary in shape to the neck mating surface so that the stem mandrel is removably coupled to the bowl mandrel by press fitting the neck into contact with the neck mating surface.

13. A method of forming a bowl with a sheet of malleable material using a bowl forming device, the device comprising:

a mandrel sleeve having a stem cavity, a bowl mating surface, and a sleeve surface, a stem mandrel having a stem surface and a neck, and bowl mandrel having a neck mating surface and a bowl surface; and the method comprising the steps of:

wrapping the malleable material around the sleeve surface of the mandrel sleeve and around the bowl surface of the bowl mandrel to form the malleable material into a malleable material cylinder, replacing the mandrel sleeve with the stem mandrel within the malleable material cylinder, forming the malleable material cylinder against the stem mandrel, and removing the stem mandrel and the bowl mandrel from the malleable material.

14. The method of claim 13, wherein the malleable material is a sheet of metal.

15. The method of claim 13, wherein the malleable material cylinder is formed against both the stem surface and the neck of the stem mandrel.

16. The method of claim 13, further comprising the step of forming the malleable material cylinder against the sleeve mating surface of the bowl mandrel.

* * * * *